US010751861B2

(12) United States Patent
Söderlund et al.

(10) Patent No.: US 10,751,861 B2
(45) Date of Patent: Aug. 25, 2020

(54) POWER TOOL WITH PULSE UNIT WITH A MAGNET FOR REMOVING PARTICLES

(71) Applicant: ATLAS COPCO INDUSTRIAL TECHNIQUE AB, Stockholm (SE)

(72) Inventors: Per Thomas Söderlund, Värmdö (SE); Niclas Mikael Wiklund, Älta (SE); Hans Niklas Öberg, Nacka (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 296 days.

(21) Appl. No.: 15/308,694

(22) PCT Filed: May 20, 2015

(86) PCT No.: PCT/EP2015/061073
§ 371 (c)(1),
(2) Date: Nov. 3, 2016

(87) PCT Pub. No.: WO2015/181011
PCT Pub. Date: Dec. 3, 2015

(65) Prior Publication Data

US 2017/0144277 A1 May 25, 2017

(30) Foreign Application Priority Data

May 28, 2014 (SE) ..... 1450641

(51) Int. Cl.
*B25B 21/02* (2006.01)

(52) U.S. Cl.
CPC ..... *B25B 21/026* (2013.01); *B25B 21/02* (2013.01)

(58) Field of Classification Search
CPC ..... B25B 21/026; B25B 21/02; F16D 37/02; B01D 35/06
(Continued)

(56) References Cited

U.S. PATENT DOCUMENTS 2,478,290 A * 8/1949 Lindner ..... B03C 1/28 210/222
3,015,343 A * 1/1962 Gardiner ..... F15B 13/0438 137/625.61
(Continued)

FOREIGN PATENT DOCUMENTS

CN 201943772 U 8/2011
CN 203442093 U 2/2014
(Continued)

OTHER PUBLICATIONS

International Search Report (ISR), Written Opinion and International Preliminary Report on Patentability (IPRP) dated Aug. 21, 2015 issued in International Application No. PCT/EP2015/061073.
(Continued)

*Primary Examiner* — Thanh K Truong
*Assistant Examiner* — Katie L Gerth
(74) *Attorney, Agent, or Firm* — Holtz, Holtz & Volek PC

(57) ABSTRACT

A power tool including a motor and a pulse unit intermittently driving an output shaft, wherein the pulse unit includes a cylinder with an inner cavity arranged to withhold a hydraulic fluid, and an anvil located inside the inner cavity, the anvil being connected to the output shaft, wherein: at least one recess is arranged inside the inner cavity wherein at least one magnet is provided inside the recess; and the at least one recess is deeper than the at least one magnet such that a pocket is formed in the recess outside the magnet.

3 Claims, 1 Drawing Sheet

(58) Field of Classification Search
USPC ..... 173/218; 210/695
See application file for complete search history.

(56) References Cited

U.S. PATENT DOCUMENTS 3,072,260 A * 1/1963 Szwargulski ..... B01D 29/33 210/223
3,195,467 A * 7/1965 Collet ..... F04D 29/047 417/420
4,026,805 A * 5/1977 Fowler ..... B01D 35/06 209/223.1
4,067,810 A * 1/1978 Sullivan ..... B01D 35/06 209/224
4,705,626 A * 11/1987 Morelli ..... B01D 35/06 210/130
5,009,779 A * 4/1991 Hebert ..... B01D 35/06 210/223
5,089,129 A * 2/1992 Brigman ..... B01D 35/06 210/223
5,092,410 A * 3/1992 Wallace ..... B25B 23/1453 173/93.5
5,556,540 A * 9/1996 Brunsting ..... B01D 35/06 184/6.25
5,969,903 A * 10/1999 Parsoneault et al. ... F16C 17/24 210/222
6,270,667 B1 * 8/2001 Nakamura ..... B01D 35/06 184/6.25
6,308,781 B2 * 10/2001 Ruttley ..... E21B 31/06 166/311
6,402,948 B1 * 6/2002 Pakki ..... B01D 17/0214 210/222
6,603,632 B1 * 8/2003 Lee ..... G11B 19/2009 360/97.12
7,216,723 B2 5/2007 Ohtsu et al.
7,329,342 B2 * 2/2008 Faria ..... B01D 29/15 210/167.03
9,194,477 B2 * 11/2015 Lee ..... F16H 57/01
9,259,826 B2 2/2016 Söderlund
2004/0245179 A1 * 12/2004 Elsegood ..... B01D 27/00 210/695
2006/0137887 A1 * 6/2006 Ohtsu ..... B25B 21/026 173/2
2013/0056237 A1 * 3/2013 Soderlund ..... B25B 21/02 173/218

FOREIGN PATENT DOCUMENTS

EP 1677022 A1 7/2006
WO 2011141205 A1 11/2011

OTHER PUBLICATIONS

Chinese Office Action dated Apr. 28, 2019 issued in Chinese Application No. 201580027189.6.
Chinese Office Action dated Nov. 4, 2019 issued in Chinese Application No. 201580027189.6.

* cited by examiner

POWER TOOL WITH PULSE UNIT WITH A MAGNET FOR REMOVING PARTICLES

The invention relates to a power tool with a pulse unit for intermittently connecting a motor to an output shaft. Specifically, the invention relates to a power tool with a pulse unit with a magnet for removing particles.

BACKGROUND

Torque delivering pulse power tools include a pulse unit that intermittently connects a motor shaft to an output shaft that is arranged to hold a tool implement. The pulse unit comprises a housing in which a cylinder is arranged to rotate. The cylinder is driven by a shaft that is driven by a motor, directly or via a gear. An anvil is arranged inside the cylinder and is intermittently driven, i.e. in pulses, by the cylinder.

Together the cylinder and the anvil form a pulse unit. There are different types of pulse units. There are piston pulse units and there are vane pulse units. In both these types a non-compressible, or close to non-compressible, hydraulic fluid is utilised as an intermediate in the generation of pulses between the components of the pulse unit.

A problem in pulse tools is the wear of the parts of the pulse unit. The wear will produce particles which in turn may lead to further wear. Air bubbles in the fluid are also harmful and may cause wear.

In WO 2011/141205 a power tool with a piston pulse unit is described. In this power tool an air separator element is arranged to remove harmful air bubbles in the fluid. The air bubbles are harmful in that their presence in the hydraulic fluid affects the properties of the hydraulic fluid and makes it compressible which in turn reduces the efficiency of the pulse unit and contributes to further wear of the moving parts of the pulse unit. In a specific embodiment in WO 2011/141205 the air separator is also provided with a filter for removing particles from the fluid.

Filters of this kind for removing harmful particles have a proven effect but problems relating to long term wear of the pulse unit are not eliminated, since the particles may wander about in the system a while before they end up in the filter.

Hence, there is a need for a construction in a power tool that helps reducing the long term wear of the parts of the pulse unit.

SUMMARY OF THE INVENTION

An object of the invention is to provide a power tool with a pulse unit with a prolonged life time.

This object is achieved by a power tool comprising a motor and a pulse unit configured to intermittently drive an output shaft, wherein the pulse unit comprises a cylinder with an inner cavity arranged to hold a hydraulic fluid and an anvil located inside said inner cavity, the anvil being connected to the output shaft. At least one magnet is provided inside the inner cavity of the cylinder.

With the inventive power tool the short and long term wear will be heavily reduced in that magnetic particles will adhere to the magnet as quickly as possible after production, such that they will not contribute to further wear of the internal parts of the pulse unit.

In a specific embodiment of the invention at least one recess is arranged inside the inner cavity and wherein at least one magnet is provided inside said recess.

In another specific embodiment of the invention the at least one recess is deeper than the at least one magnet, such that a pocket is formed in the recess outside the magnet. The pocket is useful for gathering particles.

In yet another specific embodiment of the invention the cylinder comprises a front part with a disc shaped wall through which a shaft that connects the anvil and the output shaft extends. The at least one recess may be arranged in said disc shaped wall.

In one specific embodiment of the invention the cylinder comprises at least two recesses each provided with a magnet. The effect may of course be ameliorated by the provision of further magnets.

Other features and advantages of the invention will be apparent from the figures and from the detailed description of the shown embodiment.

SHORT DESCRIPTION OF THE DRAWINGS

In the following detailed description reference is made to the accompanying drawings, of which:

DETAILED DESCRIPTION OF THE SHOWN EMBODIMENT OF THE INVENTION

Figure 1:
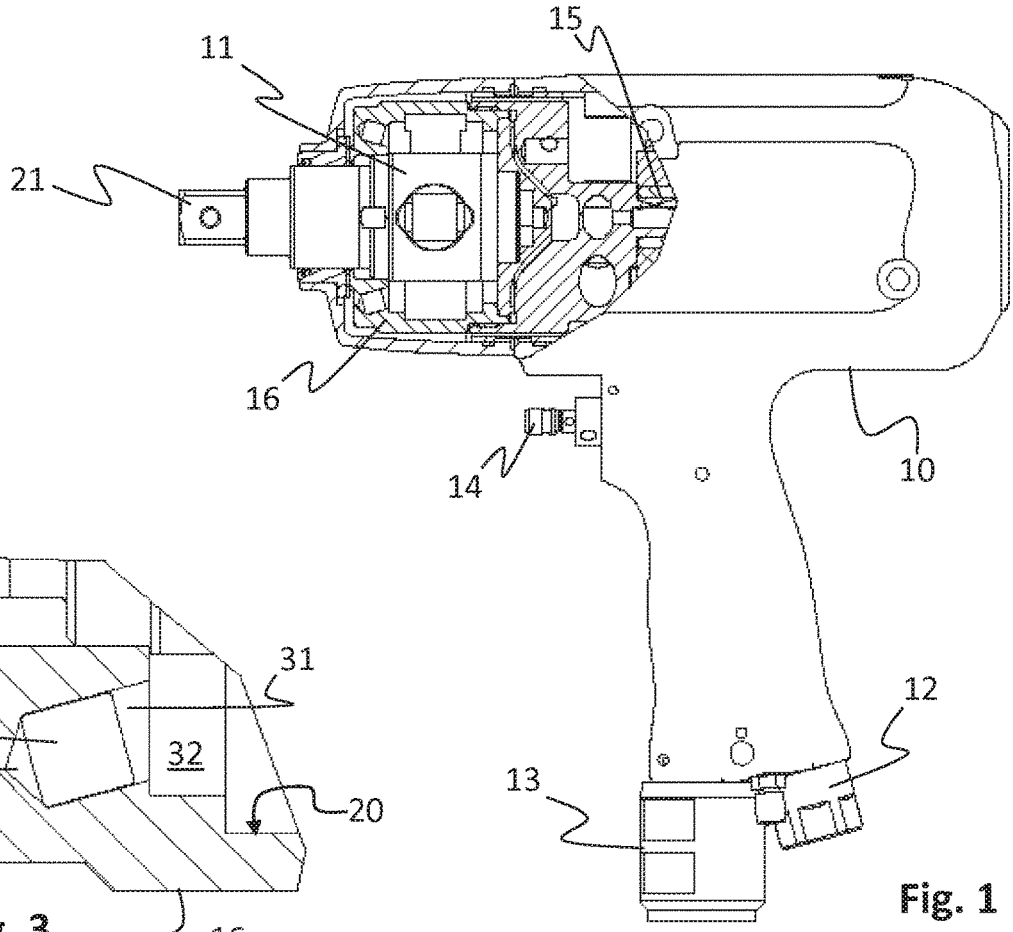
FIG. 1 shows a power tool according to a specific embodiment of the invention.

In FIG. 1 a power tool 10 is shown, partly in a cut view showing a pulse unit 11 inside the power tool. The power tool 10 comprises an air inlet portion 12, an air outlet portion 13, and a trigger 14. When the trigger 14 is pressed air will be let through to the pneumatic motor which will drive a motor shaft 15 which is firmly connected to a cylinder 16 of the pulse unit 11. The motor will intermittently drive an output shaft 21 via the pulse unit 11.

Figure 2:
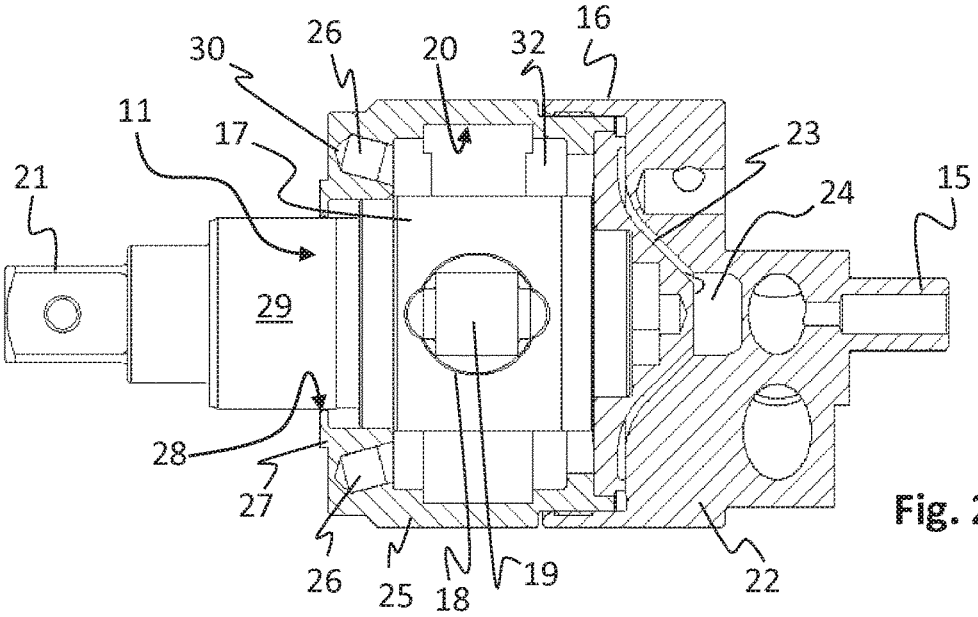
FIG. 2 shows a pulse unit of the power tool in FIG. 1.

The pulse unit 11 of the power tool 10 is shown in detail in FIG. 2.

Inside the cylinder 16 of the pulse unit an anvil 17 is arranged. In the shown embodiment the anvil 17 and the output shaft 21 are formed as one integrated piece. They may however also consist of separate parts that are intimately connected to each other. The output shaft 21 is connectable to a socket or a tool implement for providing a torque to e.g. a joint.

The anvil 17 comprises a piston opening 18 in which two pistons (not shown in the drawings) are arranged. Each piston is furnished with a roller 19 that is arranged to follow a cam surface 20 on the inside of the cylinder 16. A cam shaft (not shown) arranged inside the anvil 17 is arranged to rotate along with the cylinder 16 and to interact with the inner parts of the pistons and push these and the rollers 19 outwards into contact with the cam surface 20 of the cylinder 16.

As the pistons are pushed outwards the inner space between them is filled with the hydraulic fluid inside the cylinder 16. When the cam surface 20 of the cylinder 16 comes into contact with the rollers 19 on the pistons the hydraulic fluid will restrict the movement of the pistons into the centre of the anvil 17. Thereby, the interaction between the rollers 19 and the cam surface 20 will force the anvil 17 to rotate along with the cylinder 16 for a part of a lap. Subsequently, the motor will accelerate the cylinder 16 again until a new interaction between the cam surface 20 and the rollers 19 will force the anvil 17 to rotate a little further. In this way the anvil 17 is pulsed forward until the motor is stopped, e.g. when a target torque has been met.

Inside an end piece 22 of the cylinder 16 an air separator 23 in the form of a conical gap is arranged. The air separator 23 functions as a centrifuge in which the relatively lighter air will remain close to the centrifuge centre 24 as the hydraulic fluid will be pressed outwards and will be free from air as it is returned to the system. The air separator 23 may be provided with a particle filter (not shown) in order to separate particles from the hydraulic fluid.

The invention is based on a notion that it may be advantageous to remove harmful particles from the hydraulic fluid as soon as possible. Namely, particles that are larger than a certain size will not pass through the channels that lead out to the air separator 23. Further, smaller particles may also wander about inside the pulse unit 11, leading to further wear, before they find their way out to the air separator 23 and accompanying particle filter.

Particles in the pulse unit 11 lead to further wear of the rollers 19, cam surface 20, and other internal parts of the pulse unit 11. Large particles may be especially harmful as they may interfere with the function of the pulse unit 11 and accelerate wear between the parts as they get stuck between the moving parts of the pulse unit 11.

The invention is based on the notion that there is a breaking-in period in which an initial and relatively heavy wear occurs. The continued wear of moving parts, such as the rollers 19 and cam surface 20 may be drastically reduced if the particles from the breaking-in period may be eliminated from the hydraulic fluid before creating too much wear and damage.

According to the invention at least one magnet 26 is arranged inside the pulse unit 11, in the cavity 32 in which the anvil 17 rotates with respect to the cylinder 16. In the shown embodiment magnets 26 are arranged in a front part 25 of the cylinder 16. In the shown embodiment the air separator 23 is provided in the end piece 22 of the cylinder 16, which is firmly attached to the front part 25. The front part 25 includes the cam surface 20 and a disc shaped wall 27, which includes a central opening 28 through which a shaft 29 that connects the anvil 17 to the output shaft 21 extends.

Figure 3:
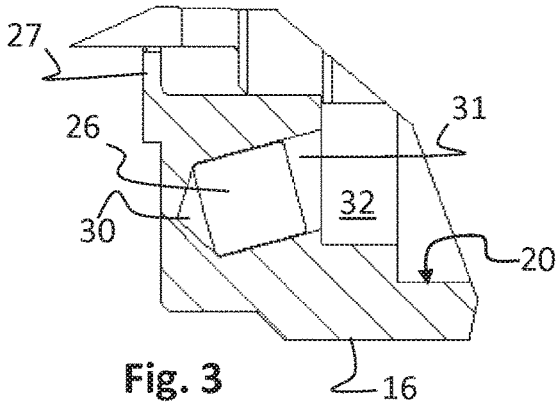
FIG. 3 shows a detailed view of a part of the pulse unit in FIG. 2.

In the shown embodiment four recesses 30 or bores are arranged in the disc shaped wall 27, whereof only two are visible in FIG. 2. In each recess 30 a magnet 26 is provided. In FIG. 3 the lower recess 30 and magnet 26 are shown. The magnets 26 are fully contained inside the recesses 30 such that a small pocket 31 is formed in the part of the recess 30 outside the magnet 26 in which magnetic metal particles may be gathered. The pocket 31 is useful for the gathering of particles, but not indispensable. If the magnet 26 is located at a position inside the cavity 32 where the hydraulic fluid is relatively unaffected by the mutually pulsating movement of the cylinder 16 and the anvil 17 the particles will remain attached to the magnet 26 without the provision of a specifically dedicated pocket.

In the shown embodiment four recesses 30 are arranged in the disc shaped wall 27 of the front part 25. There may however be less or more recesses and magnets. An effect is of course achieved with only one magnet and may be improved by the provision of 2, 3, 4, 5, 6 or more magnets, preferably evenly distributed inside the pulse unit 11. Further, the recesses and magnets may be located at other locations in the cavity 32 inside the cylinder 16. Magnets may be provided in the end piece 22 of the cylinder 16, or next to the cam surface 20 along the circumferential inner wall of the cylinder 16, or in the peripheral surface of the anvil 17.

It is however advantageous if the magnets 26 are located in the cavity 32 inside the cylinder 16 in which the anvil 17 is provided.

Above, the invention has been described with reference to a specific embodiment. The invention is however not limited to this embodiment. It is obvious to a person skilled in the art that the invention comprises further embodiments within its scope of protection, which is defined by the following claims.

The invention claimed is:

1. A power tool comprising:

a motor; and a pulse unit configured to intermittently drive an output shaft which is located at a front part of the power tool;

wherein:

the pulse unit comprises a cylinder with an inner cavity arranged to hold a hydraulic fluid, and an anvil located inside the inner cavity, the anvil being connected to the output shaft;

the cylinder comprises a front part having a disc shaped wall, the disc shaped wall including a central opening, a shaft extends through the central opening in the disc shaped wall toward the front of the power tool, the shaft connecting the anvil and the output shaft;

at least one bore is provided in the disc shaped wall adjacent to the central opening, the at least one bore extending in the disc shaped wall toward the front of the power tool, the at least one bore having a closed end inside the disc shaped wall, and the at least one bore having an open end facing an inside of the inner cavity;

at least one magnet is provided inside the at least one bore;

the at least one bore is deeper than the at least one magnet such that the at least one magnet is fully contained inside the at least one bore and such that a pocket is formed in the at least one bore outside the at least one magnet at the open end of the at least one bore facing the inside of the inner cavity, the pocket being configured to gather magnetic particles.

2. The power tool according to claim 1, wherein:

the at least one bore comprises at least two bores;

the at least one magnet comprises at least two magnets;

one of the at least two magnets is provided in each one of the at least two bores.

3. The power tool according to claim 1, wherein the at least one magnet is provided inside the at least one bore such that the pocket is located between the at least one magnet and the inner cavity of the cylinder.

* * * * *